US009989335B2

(12) United States Patent
Purvis

(10) Patent No.: US 9,989,335 B2
(45) Date of Patent: Jun. 5, 2018

(54) DEVICE WITH MULTIPLE SELECTABLE LESS-LETHAL OPTIONS

(71) Applicant: James Wayne Purvis, Albuquerque, NM (US)

(72) Inventor: James Wayne Purvis, Albuquerque, NM (US)

( * ) Notice: Subject to any disclaimer, the term of this patent is extended or adjusted under 35 U.S.C. 154(b) by 0 days. days.

(21) Appl. No.: 15/624,636

(22) Filed: Jun. 15, 2017

(65) Prior Publication Data

US 2017/0292816 A1 Oct. 12, 2017

(51) Int. Cl.

| | |
|---|---|
| ***F41C 9/00*** | (2006.01) |
| ***F41H 13/00*** | (2006.01) |
| ***F41H 9/10*** | (2006.01) |
| ***F41A 21/06*** | (2006.01) |
| ***F41G 1/35*** | (2006.01) |
| ***F41A 19/59*** | (2006.01) |
| ***F41A 35/06*** | (2006.01) |
| ***F41A 21/02*** | (2006.01) |

(52) U.S. Cl.

CPC ..... *F41H 13/00* (2013.01); *F41A 19/59* (2013.01); *F41A 21/02* (2013.01); *F41A 21/06* (2013.01); *F41A 35/06* (2013.01); *F41G 1/35* (2013.01); *F41H 9/10* (2013.01); *F41H 13/0025* (2013.01)

(58) Field of Classification Search

CPC ..... F41H 1/00; F41H 1/02; F41H 5/08

See application file for complete search history.

(56) References Cited

U.S. PATENT DOCUMENTS

| | | | |
|---|---|---|---|
| 3,950,875 | A | 4/1976 | Hirschfeld |
| 5,060,314 | A | 10/1991 | Lewis |
| 5,689,908 | A | 11/1997 | Brandl |
| 6,108,813 | A | 8/2000 | Tolliver et al. |
| 6,135,005 | A | 10/2000 | Dobbins |

(Continued)

FOREIGN PATENT DOCUMENTS

| | | | |
|---|---|---|---|
| WO | WO 2005/099499 | 10/2005 | |
| WO | WO 2005099499 A1 * | 10/2005 | ..... A41D 13/08 |

OTHER PUBLICATIONS

Cavendish, Richard, "The Gatling Gun Patented", History Today, Nov. 2012.

(Continued)

*Primary Examiner* — Gabriel J. Klein

(57) ABSTRACT

The present invention discloses a personal protection device for using multiple less-lethal ammunition options. The device is comprised of a lightweight carbon-composite forearm gauntlet sleeve assembly having a multiplicity of external mounts for shortened vented composite less-lethal ammunition barrels of various calibers or other less-lethal ammunition dispensers. In addition, Picatinny Rail attachment points are provided for mounting external tactical gear. Internally, the gauntlet sleeve assembly contains a pistol grip with an electronic control system for selecting and activating individual less-lethal ammunition dispensers in any desired sequence. The invention thus provides the user with multiple selectable less-lethal ammunition options in a single reconfigurable device requiring only one-handed operation while protecting the operating arm. The device has defense utility for both law enforcement and civilians in riots, violent protests, domestic disturbances, commercial aircraft cabins, cruise ships, malls, warehouses, offices and home defense.

5 Claims, 5 Drawing Sheets

(56) References Cited

U.S. PATENT DOCUMENTS

| | | | | |
|---|---|---|---|---|
| 6,318,014 | B1 | 11/2001 | Porter | |
| 7,302,880 | B1 * | 12/2007 | Elasic | F41H 5/08 89/36.01 |
| 7,571,493 | B1 | 8/2009 | Purvis et al. | |
| 7,752,974 | B2 | 7/2010 | Wenass et al. | |
| 8,079,169 | B2 | 12/2011 | Gregg | |
| 8,154,844 | B2 | 4/2012 | Brown | |
| 8,549,783 | B2 | 10/2013 | Marquez | |
| 8,782,938 | B2 | 7/2014 | Teach, Jr. et al. | |
| 2002/0178485 | A1 * | 12/2002 | Medves | A41D 19/0089 2/161.6 |
| 2004/0154071 | A1 * | 8/2004 | Frahm | A41D 19/0024 2/160 |
| 2005/0193465 | A1 * | 9/2005 | Salvitti | A63B 71/14 2/161.5 |
| 2008/0087684 | A1 * | 4/2008 | Koshimoto | B65D 83/20 222/192 |
| 2010/0077912 | A1 * | 4/2010 | Smith | F41H 5/08 89/36.07 |
| 2011/0013337 | A1 * | 1/2011 | Brown | F41H 5/08 361/232 |
| 2011/0226123 | A1 * | 9/2011 | Priebe | F41H 5/08 89/36.02 |
| 2012/0180636 | A1 | 7/2012 | Seuk | |
| 2012/0183636 | A1 * | 7/2012 | Kim | A61K 35/742 424/780 |

OTHER PUBLICATIONS

Dillon Aero, The M134 Minigun, New Scientist, https://www.dillonaero.com.

* cited by examiner

DEVICE WITH MULTIPLE SELECTABLE LESS-LETHAL OPTIONS

FIELD OF THE INVENTION

This invention relates generally to less-lethal weapon systems, and in particular to a wearable personal protection device for using multiple selectable less-lethal ammunition options.

BACKGROUND OF THE INVENTION

Humans have always desired a hand-held personal defense device combining body armor and multiple deterrent options. Egyptians, Sumerians, and medieval knights all used forearm armor. Possibly the earliest device with a capability for multiple, selectable types of ammunition was the versatile bow and arrow, although limited to a single dispersion mechanism and two-handed operation. Subsequent catapults, trebuchets, and cannons, all having multiple ammunition options, were definitely not hand-held. Leonardo da Vinci's tank was perhaps the first multi-barreled multi-ammunition protective-armor weapon with a select-and-fire-at-will capability, although obviously of single calibers and definitely not hand-held.

By the 1900's, the Henry repeating rifle offered a rapidly-fired multiple shot capability, but with only of a single type of ammunition and caliber, two-handed operation and no protective armor. A contemporary weapon, the Colt Single Action Army revolver, was a compromise between "almost" multiple barrels with single-handed operation, but again only a single caliber and type of ammunition and no protective armor. Gatling's Gun and the modern Dillon Aero mini-gun derivative are true multi-barreled weapons. Although only single calibers, ammunition can be of mixed types, e.g. tracers and armor-piercing incendiary, but cannot be individually selected, not hand-held, and offer and no protective armor.

A major issue presently facing both Law Enforcement officers and civilians is the use of deadly force in situations when the use of less-lethal means would be more appropriate. Less-lethal projectile weapons provide law enforcement, military personnel, and civilian defenders with an alternative to firearms in hostile encounters. While firearms are necessary and appropriate for adjudicating deadly force encounters, less-lethal projectile weapons afford operators a tool which can be effectively used across a broader range of the use-of-force spectrum. An aggressor can be forced to flee to avoid pain, or can be incapacitated by either chemicals or by the blunt force impact of a projectile shot from a less-lethal weapon, with less risk of serious injury to the aggressor and without exposing the operator to undue danger.

For less-lethal ammunition (LLA) use, the 12 gauge pump shotgun is the current standard for law enforcement. Although single barrel and single caliber, varied ammunition types are available; however, rounds must be fired in reverse order of loading and cannot be individually selected. Also, LLA designed for long-range outdoor use can be lethal when used indoors and at close ranges. Tactically, long guns are not the best option for use indoors and in tight urban spaces. Further, both hands are required for operation, and no arm armor is provided.

Conventional firearms are often converted or used as-is to shoot specialized less-lethal ammunition, including bean bags, rubber slugs, rubber shot, and wood dowels, as well as incapacitating agents such as CS and pepper spray. Special ballistic projectile rounds have been developed for use in conventional 12-gauge shotguns, such as the Remington 870 and Mossberg 500, using a standard 2½" 12-gauge shell with a reduced propellant charge that dispenses the LLA. While other firearms and launchers, such as 37 mm flare guns and 40 mm grenade launchers, also have been converted to use less-lethal rounds, the 12-gauge shotgun shell generally provides the most suitable round for less-lethal ballistic projectiles and is very cost effective. Compared to the lethal loads and bullets fired from such conventional firearms, the blunt force impact projectiles are much larger, softer on impact and travel at much slower velocities from the less-lethal projectile weapons so that they do not produce lethal penetrating wounds. There is a potential when using conventional firearms for confusion between less-lethal projectile rounds and conventional lethal ammunition rounds in a stressful tactical situation. Shotguns are large weapons that generally require both hands to manipulate and are not ideal for use inside homes or other buildings. Shotguns also must be held or slung, rather than simply holstered, for general carry.

Other less-lethal weapon options include hand-held electroshock devices, electrical stun weapons, and chemical irritants such as pepper spray and CS gas. The electric incapacitating weapons deliver a high-voltage electrical shock through direct contact with electrodes that are either attached to a hand-held device or are projected by a hand-held dispenser with wires connected to the electrodes. Generally, receiving an electrical shock or dose of chemical spray from such weapons incapacitates an assailant for a period of time.

Less-lethal ammunition options are difficult or inconvenient to use in conjunction with another weapon or when an operator needs one hand free for other tasks. For example, a soldier or police officer will generally stow their less-lethal device in a holster or holder when not in use to allow them to perform such tasks as handling a firearm, wielding a hand-held shield, or frisking and handcuffing a suspect. With the less-lethal device stowed, the operator may not be able to retrieve it in time to defend against an attack.

It is desirable therefore to have a device: 1) providing a forearm platform for attaching multiple varied LLA dispenser options, each individually selectable and dispensable in any order; 2) accepting shortened vented light-weight composite barrels with reduced muzzle velocities to minimize accidental lethality at close ranges from conventional firearm LLA used indoors and in confined urban areas; 3) rapidly configurable "on-scene" by an operator; 4) having tactical gear attachment hardpoints; 5) requiring only single-handed operation with an operator handprint similar to a high ammunition capacity pistol; and 6) providing protective armoring for the operating arm and hand. Modern technology, lightweight materials and solid-state electronics now make such a device possible. Preliminary engineering design studies have proven that a reinforced carbon-composite forearm gauntlet having one Taser™ cartridge and a plurality of shortened lightweight composite-material multi-caliber barrels for using conventional LLA can be constructed to weigh about the same as a .45 caliber 1911A1 Automatic Colt Pistol with a fully loaded 8-round magazine. Some applications of such a device include: a less-lethal law enforcement option for close-quarters street disturbance response, prison riots, shipboard and aircraft cabin use, domestic violence incident control, as well as a less-lethal personal defense device for offices, warehouses, malls, homes and schools.

DESCRIPTION OF RELATED ART

A cursory literature search uncovered literally thousands of patents and devices comprising only one or two features of the present invention, as well as seven patents that comprised three desired features; however, no device was found which comprised all desirable incorporated features described herein for the present invention. For example, there are many handheld less-lethal ammunition dispensers, but each generally uses only one ammunition type or is restricted to a single barrel option. There are many forearm protection devices, including gauntlet gloves and small hand-held ballistic shields, but none which combine complete enclosure of the entire forearm and hand with a hardened solid structure, which protect the hand grip and trigger of an internal weapon control system, and which also offer the capability for multiple selectable options for dispensing less-lethal ammunition from a single device.

Many weapons have barrel replacement capability, including caliber change, but this is usually done by a certified weapons armorer. There are weapons with variable caliber barrels, such as double barreled dual-gauge shotguns or military rifles with attached 40 mm grenade launchers, but each barrel has a separate trigger and firing pin. There are multi-barreled weapons with a single trigger and firing pin, such as Gatling's Gun or the Dillon Aero Minigun, but all barrels are of the same caliber. Further, none offer a barrel and caliber exchange with the ease and utility provided by the current invention.

Other less-lethal ammunition dispensers such as the previously mentioned pump shotguns comprise a multi-round magazine capable of containing different ammunition options; however, individual rounds within the magazine must be used in the reverse order in which they were loaded and are not selectable at will for a desired firing order. Most modern law enforcement and military weapons are designed for ambidextrous use and have hardpoints for attaching tactical equipment, so these two features have been incorporated in the present invention. Representative prior art is presented below.

Related Art—Multiple Barrel Capability

U.S. Pat. No. 3,950,875, to Hirschfeld discloses a trigger for selectively discharging simultaneously any number of barrels on a multiple-barreled firearm with a barrel assembly having a plurality of substantially parallel barrels. The mechanism comprises a like plurality of firing assemblies, each assembly being associated with one barrel. The firing assembly is arranged to selectively discharge one or more cartridges. The assembly includes a trigger adapted to engage and release the firing assembly in sequence, and it includes means for adjustably controlling the number of firing assemblies which can be released upon a single actuation of the trigger.

U.S. Pat. No. 8,782,938 to Teach, Jr. et al. discloses a lightweight handheld less-lethal ballistic projectile launcher configured as an "over/under" double barreled handheld device with a "break open" loading action. The launcher includes a barrel section pivotally connected to the receiver section. The barrel section pivots between an open load/unload position and a closed firing position. The barrel section includes two metal barrel sleeves that are press fitted into axial bores formed in the body of the barrel section. The barrel section also includes an ejector, which locks the barrel section in the closed firing position and partially expels spent rounds from the barrel sleeves when the barrel section is opened. The receiver section houses the launcher's fire control mechanism. The fire control mechanism uses a traditional single action operation and ensures that rounds are alternatively discharged from each barrel and prevents rounds from both barrels from being discharged simultaneously.

U.S. Pat. No. 8,079,169 to Gregg discloses a caliber exchange system for a firearm including a lower plate adapted for embedding within a firearm stock, an upper plate adapted to mate with the lower plate, and a receiver and integral barrel assembly attached to the upper plate to form a caliber exchange unit, the caliber exchange unit attachable and detachable from the lower plate to allow user exchange of caliber of the firearm. The barrel seating method for the upper weapon section is for bolt action rifles.

U.S. Pat. No. 6,135,005 to Dobbins discloses a two-barrel over-and-under gun for firing two types of ammunition with a single breech locking mechanism for both barrels. The gun includes a selector lever for activating one of two bolts associated with the two barrels, and a single trigger for firing ammunition from a chamber associated with the activated bolt. The gun further includes two magazines for feeding ammunition to the chambers, and a pump-action forearm for ejecting spent ammunition and for loading a new round of ammunition into the chamber associated with the activated bolt.

U.S. Pat. No. 5,689,908 to Brandl discloses a rifle construction with a swing-type barrel assembly adapted for firing both conventional cartridges and non-conventional cartridges with a longitudinally extending barrel assembly having a first barrel and a second barrel mounted in opposed relation. A breech block interposed between the barrels is adapted for sliding cooperative movement with the first or second barrels in order to expel desired cartridges depending on the mode of operation. A housing is adapted to receive the barrel assembly in first and second firing positions.

U.S. Pat. No. 8,549,783 to Marqez discloses a tactical apparatus and method for mounting a multi-cartridge electric discharge weapon. The apparatus includes a frame shaped to define a rail system permitting handles and accessories to be mounted thereupon and used in conjunction with the mounted electric discharge weapon. The apparatus also includes at least one handle, a control housing, and a mounting plate wherein a plurality of firing cartridges from a multi-cartridge electric discharge weapon may be mounted on the mounting plate, permitting an available multi-cartridge electric discharge weapon to be converted from a fixed or vehicle mounted position to a hand-carried position where it may be carried, aimed, and fired as a conventional weapon.

U.S. Pat. No. 6,318,014 to Porter discloses a handgun adapter for converting a handgun into a rifle or carbine. The adapter includes an elongated member having a stock and a pair of sidewalls forming a cavity. A pair of guide rails is positioned on an inner edge of the cavity, and a locking bar is mounted within the sidewalls and extends across the cavity. The locking bar is selectively positionable between a locked position and an unlocked position. A handgun mounts into the adapter by aligning channels on the outer edge of the handgun into the guide rails. The handgun is slid along the guide rails and into the locking mechanism for attachment. Replacing the handgun effectively replaces the barrel and may be used to change the caliber of the device.

Related Art—Gloves-Gauntlets-Handheld Ballistic Protection

U.S. Pat. Appl. No. 2002/0178485 to Medves discloses a protective glove with a stiffened cuff for attachment to the wrist or another garment. International Pat. Appl. WO 2005/099499 to Angus et. al. discloses a flexible protective sleeve and glove combination for hands and arms comprised of cut resistant material The device is separable into glove, wrist cuff, forearm and upper arm sections, but offers no ballistic protection or weapons capability and cannot be configured for such. U.S. Pat. Appl. No. 2005/0193465 to Salvitti discloses an unusual reconfigurable device comprising hooks and straps for retaining objects such as a gun to a hand of a user. The device offers no ballistic protection.

U.S. Pat. No. 6,108,813 to Tolliver et al. discloses a ballistic-resistant upper arm shoulder pad (epaulet) made of 30 layers of an aramid fiber (e.g., KEVLAR™) ballistic cloth that covers the shoulder and upper arm. U.S. Pat. No. 5,060,314 to Lewis discloses a similar type of protective deltoid pad. However, neither patent provides any type of protection for the elbow, lower arm, or hand.

U.S. Pat. Appl. No. 2012/0180636 to Seuk discloses a nominally flat ballistic shield with forearm restraints and an integral glove facilitating hand deployment. The interior of the shield consists of layers of ballistic protection materials including polyethylene fiber composites, aramid fibers, thin steel sheets, and composite ceramic trauma plates. U.S. Pat. Appl. No. 2011/0226123 to Priebe et. al. discloses a first responder flat shield apparatus with an on/off switch for two attached floodlights. A handle and a detachable shoulder strap allows for one-arm deployment. The device has no provision for but mentions the addition of video cameras or other sensors.

U.S. Pat. No. 7,517,493 to Purvis et al. discloses a lightweight, armored protective garment for protecting an arm or leg from blast superheated gases, blast overpressure shock, shrapnel, and spall from an explosive device, such as a Rocket Propelled Grenade (RPG) or a roadside Improvised Explosive Device (IED). The garment has a ballistic sleeve made of a ballistic fabric, such as an aramid fiber (e.g., KEVLAR™) cloth, that prevents thermal burns from the blast superheated gases, while providing some protection from fragments. Additionally, the garment has two or more rigid armor inserts that cover the upper and lower arm and protect against high-velocity projectiles, shrapnel and spall. The rigid inserts can be made of multiple plies of a carbon/epoxy composite laminate. The combination of 6 layers of KEVLAR™ fabric and 28 plies of carbon/epoxy laminate inserts (with the inserts being sandwiched in-between the KEVLAR™ layers), can meet the level IIIA fragmentation minimum V.sub.50 requirements for the U.S. Interceptor Outer Tactical Vest.

Related Art—Combined Ballistic Protection and Weapons

U.S. Pat. No. 7,302,880 to Elasic discloses a flat ballistic shield with a handle to allow one-arm deployment. The shield has capability for two firearms or less-lethal devices orthogonally mounted to and dischargeably operated from the shield. A battery may be included for recharging electroshock devices. Other weapons or accessories mounts may be added to the shield. U.S. Pat. Appl. No. 2004/0154071 to Frahm discloses an improved electrical stun weapon comprising an enclosed power source, electronics package, trigger mechanism, and external discharge contacts contained within an insulated glove with retaining cuff. U.S. Pat. Appl. No. 2010/0077912 to Smith et. al. discloses a portable shield of ABS plastic enclosing circumferentially three-fourths of the forearm and hand. The device has a hand grip with an enclosed pepper spray canister for one-arm deployment as well as an internal restraining strap.

U.S. Pat. Appl. No. 2011/0013337 to Brown discloses a combined gauntlet-style glove and small external solid shield assembly with the solid portion only covering the top of the forearm and integral with a flexible protective glove extending to the elbow. The hard shield portion encloses a portable source of electricity with a remote compression switch wired to an electroshock arc head comprising two contact points. Brown anticipates attaching a video camera and a single electrically activated LLA dispenser, such as a chemical irritant spray, an electroshock projectile probes dispenser, or other LLA device. With the exception of the attached upper arm electric contacts, all other anticipated optional attached devices require two-handed operation. Subsequent U.S. Pat. No. 8,154,844, to Brown in 2012 discloses again a wearable shield and self-defense device including multiple integrated components. The defense device includes a composite shield member configured to be worn over at least a third of the length of a user's forearm for protection. The device conforms closely to the outer surface only of the forearm. The shield does not completely enclose either the forearm circumferentially, or any portion of the hand. The shield member includes a portable source of electricity and an electrical shock bar configured to receive an electrical current from the electrical source and to deliver an electrical shock. Multiple devices are claimed for attachment to the shield and the electrical source. The Brown device is basically an arm mounted rechargeable battery with power cord. Brown claims that the device can be used individually with virtually every piece of equipment known to law enforcement and first responders, to include as cited: electroshock cartridges, chemical cartridges, some undefined LLA dispensers, defibrillators, hazmat chemical sensors, radiation sensors, biohazard sensors, video cameras, satellite uplinks, and voice translators. While technically the device can be configured on-site by connecting separate preselected individual equipment to the enclosed battery, to include all options as cited would require a semi-truck for transport.

SUMMARY OF THE INVENTION

The above recitations of related art make clear that 1) protective shields, sleeves and solid gauntlets are desirable for arm protection; 2) multi-barreled weapons are desirable; 3) multiple LLA dispensers are desirable with selectable firing order capability; 4) single handed operation of protective shield designs is desirable; 5) some types of hand grips with weapon control capability is desirable; and 6) some rapidly reconfigurable protection system capability is desirable. It is the new and useful aspect of the present invention to combine a novel electronic single hand grip control system for non-sequential individual selection and firing of multiple LLA dispensers into a platform incorporating with "on-scene" configurability as well as the other desirable and useful aspects as noted above. No such reconfigurable all-solid protective gauntlet sleeve assembly exists having a unique single controller embedded in the hardened protective gauntlet sleeve providing for non-sequential selection and activation of individual LLA dispensers.

It is an aspect of the present invention to completely enclose the forearm and hand in a structurally solid yet re-configurable protective gauntlet sleeve assembly fabricated of lightweight composite materials, so as to protect the hand and forearm. It is another aspect of the present invention to present a protective gauntlet sleeve assembly having multiple embedded Picatinny Rails and hardpoints for attaching either less-lethal ammunition barrels of various calibers, less-lethal ammunition dispensers not requiring a separate barrel, or operator-configured tactical equipment. It is yet a further aspect of the present invention to present a personal protection device which is operable with a single hand using an internal hand grip. It is yet another aspect of the present invention to present a device for personal protection having a selectable firing order for multiple less-lethal ammunition dispensers. It is yet a further aspect of the present invention to present a device for personal protection containing an electronic control system for selecting and firing each individual less-lethal ammunition dispenser option in any order. It is yet a further aspect of the present invention to present a personal protection device which is rapidly reconfigurable "on-scene" with LLA options. Thus with these aspects a new and useful invention for rapid selection and use of varied less-lethal defense options is disclosed. \

BRIEF DESCRIPTION OF THE DRAWINGS

The accompanying drawings, which are incorporated in and form part of the specification, illustrate various principles of operation and examples of the present invention, including a best mode of the general embodiment of the invention, as well as alternate embodiments, and, together with the detailed description, serve to explain the principles of the invention.

DETAILED DESCRIPTION OF PREFERRED EMBODIMENTS

The present invention will now be described more fully hereinafter with reference to the accompanying drawings, wherein like numbers refer to like elements throughout. It is to be understood, however, that the detailed description of the various embodiments and specific examples, while indicating preferred and other embodiments of the present invention, are given by way of illustration and not limitation. This invention may, however, be embodied in many different forms and should not be construed as limited to the embodiments set forth herein. Rather, these embodiments are provided so that this disclosure will be thorough and complete, and will fully convey the scope of the invention to those skilled in the art. Many changes and modifications within the scope of the present invention may be made without departing from the spirit thereof, and the invention includes all such modifications.

Figure 1:
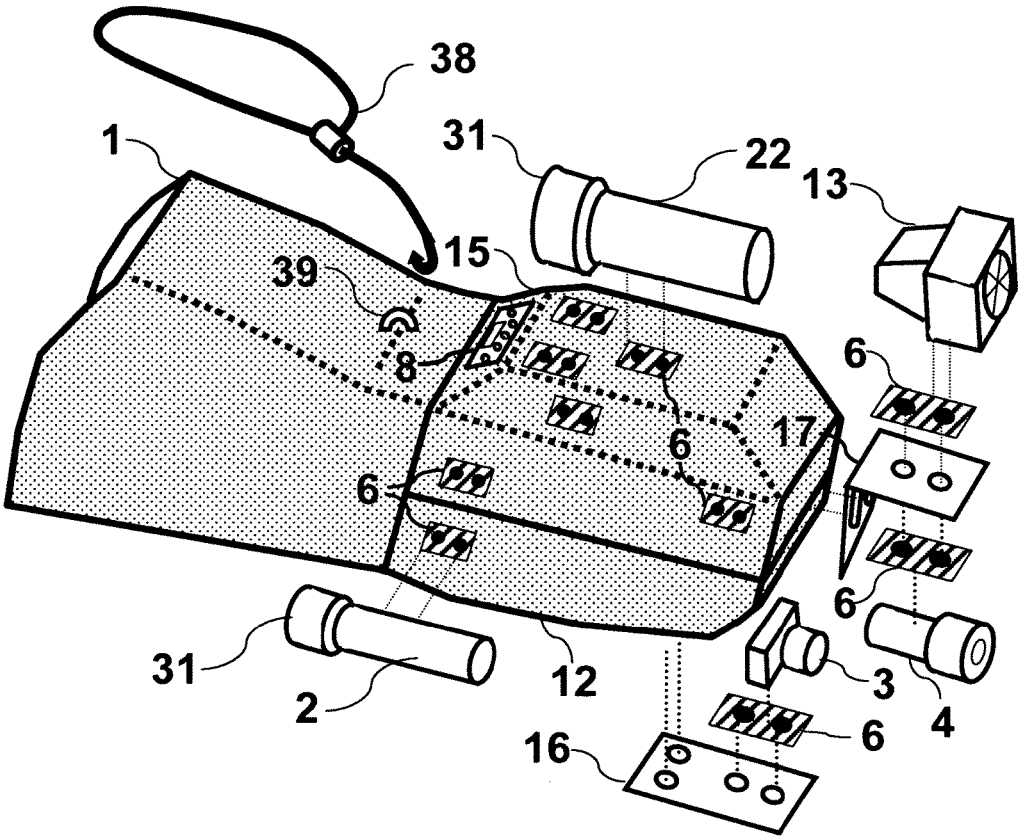
FIG. 1 presents an exterior view of the best mode of the general embodiment.

The basic operating principle of the present invention is illustrated in FIG. 1, which is an exterior exploded view of the best mode of the general embodiment. The mainstay of the invention is the carbon fiber composite forearm gauntlet sleeve assembly comprised of elements 1,12,15 and designed to completely envelop the forearm and hand up to the elbow. The carbon fiber materials comprising the structure can take many forms, from woven fabric to wound fibers, and may also have embedded layers of aramid ballistic fibers or metal strips. A plurality of Picatinny Rails 6 are premounted on the gauntlet sleeve assembly for attaching desired and available less lethal ammunition dispensers such as the illustrated foreshortened vented lightweight composite barrels 2 and 22 of calibers 12-gauge and 40 mm, respectively. By way of illustration only, each of the barrels 2,22, shown are removable and replaceable, with each barrel having an associated electric firing pin assembly 31. This embodiment of the present invention also has designed in hardpoints for attaching tactical equipment brackets 16,17. The brackets 16,17 may be used alone or have Picatinny Rails 6 attached to them to facilitate the attachment of LLA dispensers and tactical equipment including a miniature video camera 3, a flashlight 4 with an embedded laser designator, and an electroshock cartridge 13. An external display panel 8 provides the operator with weapon status information, such as ON-OFF power, weapon safety ON-OFF status, individual dispenser selection indication by light emitting diodes, and battery charge level. This embodiment allows for attachment of up to seven barrels as well as the electroshock cartridge, thus giving the operator eight less-lethal options in one handheld device. An adjustable lanyard 38 is secured to attachment loop 39 and slung over the shoulder of the operator to reduce carriage stress and free both hands.

Figure 2A:
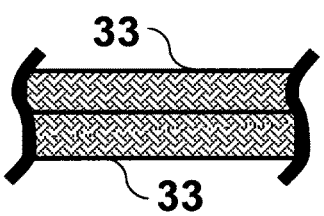
FIGS. 2A, 2B and 2C present three options for the gauntlet sleeve composition.
Figure 2B:
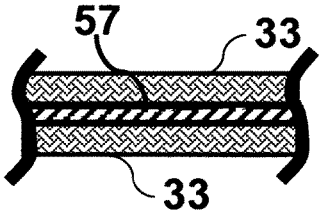
Figure 2C:
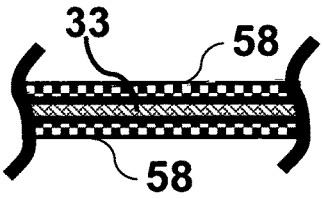

FIGS. 2A, 2B, and 2C illustrate three construction options of the gauntlet sleeve surfaces 1,12,15. FIG. 2A illustrates a common carbon fiber cloth assembly wherein two layers 33 of thick bias-ply weave cloth are bonded to form the sleeve. FIG. 2B is an improved embodiment over that shown in FIG. 2A, wherein two thinner layers 33 of carbon fiber bias-ply cloth are used to sandwich a layer 57 of aramid ballistic fibers. FIG. 2C is the best mode embodiment wherein one thinner layer 33 of carbon fiber bias-ply cloth is used as a central base structural support for two layers 58 of graphene sheets.

Figure 3:
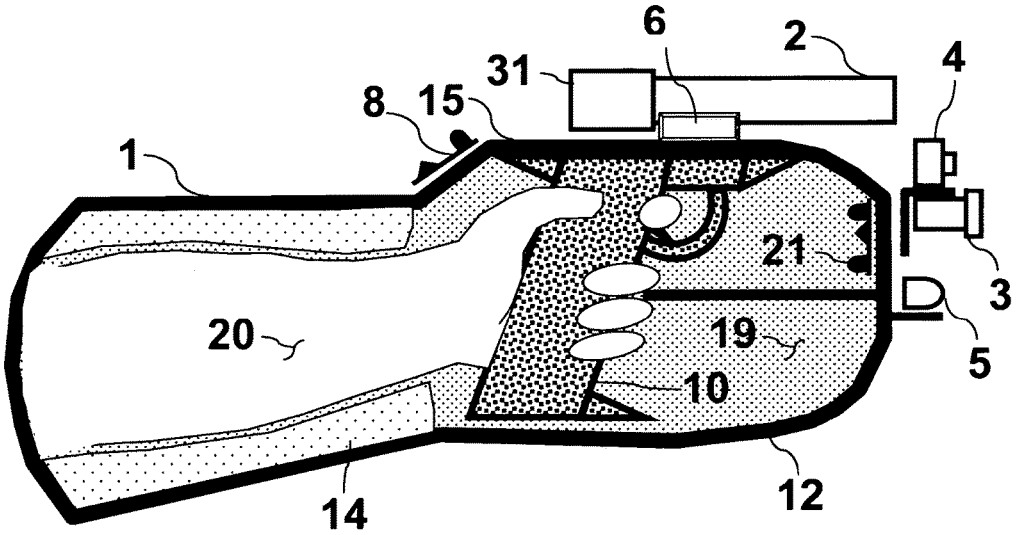
FIG. 3 presents a cutaway side view illustrating the interior of the gauntlet sleeve assembly embodiment.

FIG. 3 presents a cutaway side view of the interior of the general embodiment in FIG. 1, which is the full gauntlet sleeve assembly 1,12,15. The operator's arm 20 is inserted up to the elbow into an opening in the gauntlet rear forearm piece 1 and nestled in padding 14. The operator hand grasps an internal pistol-style hand grip controller 10 which is attached to the gauntlet front upper piece 15 with four #4-40 hex head machine screws. An electronics storage area 19 is provided for electroshock weapon electronics. A shortened lightweight composite 12-gauge barrel 2 with an attached firing pin assembly 31 is shown externally top-mounted to a Picatinny Rail 6 above the internal hand grip 10. An external light emitting diode (LED) display panel 8 provides the operator with weapon status information, including ON-OFF power, weapon safety ON-OFF status, barrel selection, and battery charge level. An optional tactical video camera 4, tactical flashlight 3, and laser designator 5 are shown front mounted to brackets.

Figure 4:
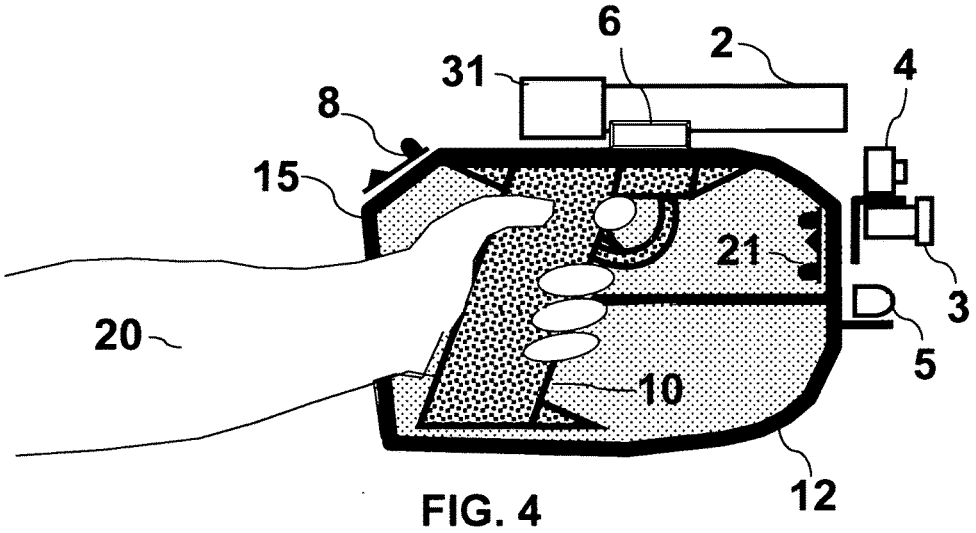
FIG. 4 presents a cutaway side view illustrating the interior of a gauntlet embodiment with the rear forearm piece of the gauntlet sleeve assembly removed.
Figure 5:
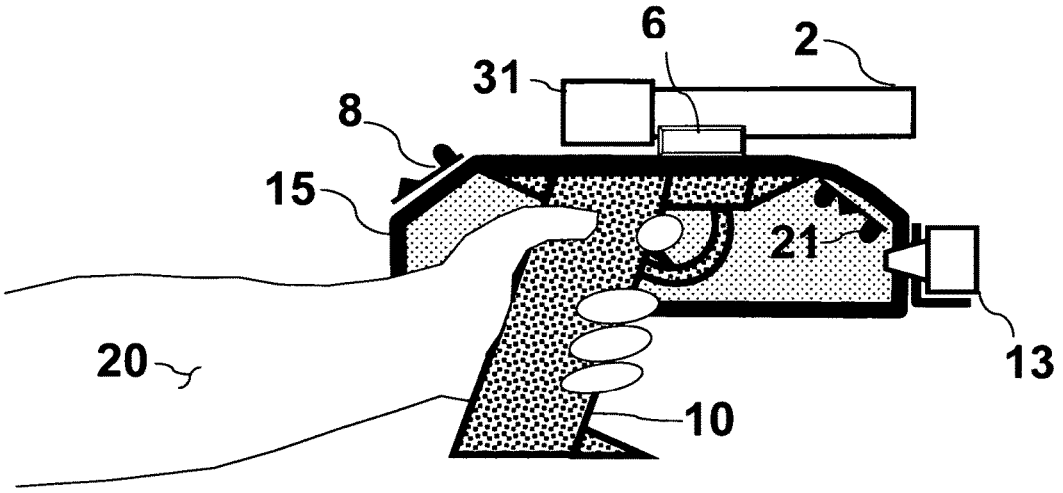
FIG. 5 presents a cutaway side view illustrating a gauntlet sleeve assembly embodiment with both the front lower piece and the rear forearm piece removed.

FIGS. 4 and 5 present cutaway schematics views illustrating two variations of the embodiment in FIG. 3 in which portions of the gauntlet sleeve assembly are removed. Shown in FIG. 4, the rear forearm piece 1 of the gauntlet sleeve assembly aft of the wrist and up to the elbow is removed to provide a lighter, more flexible configuration 1,15 which fully encloses the hand and wrist. This configuration is basically a lightweight 1-barrel to 7-barrel selected-fire pistol with options for varied barrel caliber and tactical gear mounts. FIG. 5 illustrates a version of the embodiment of FIG. 3 wherein both the rear forearm piece 1 and the front lower piece 12 under the hand in the gauntlet sleeve assembly are removed to provide a lighter, more flexible configuration 15 which protects only the top of the hand. This version is basically a lightweight 1-barrel to 5-barrel selected-fire pistol with options for varied barrel caliber and tactical gear mounts.

Figure 6:
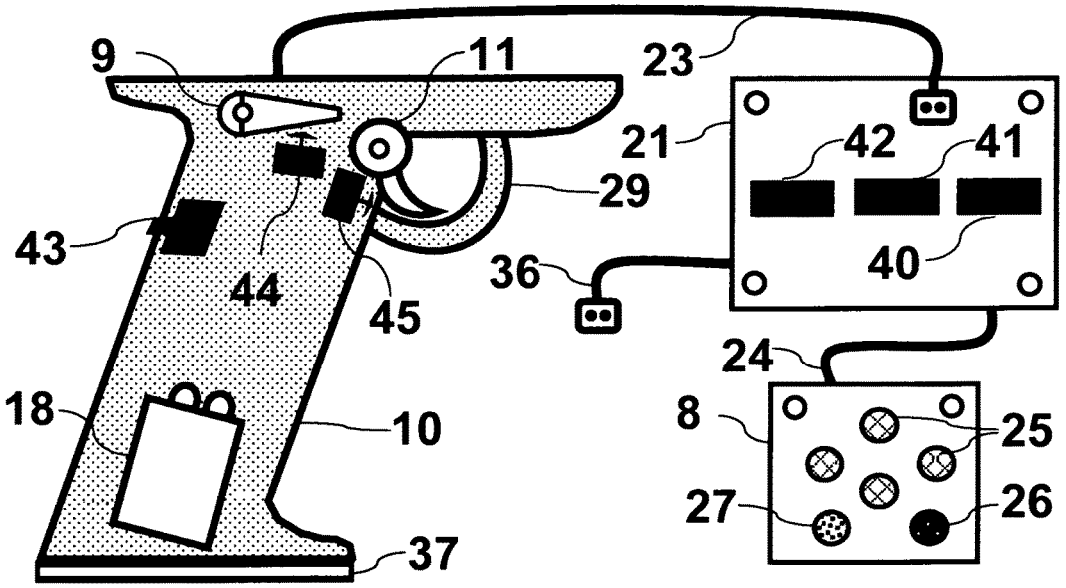
FIG. 6 presents a schematic view illustrating the electronic pistol grip and PCB control system.

FIG. 6 illustrates the elements of the internal pistol-type hand grip 10 and the associated electronic control system printed circuit boards (PCBs) 8 and 21. The pistol-type hand grip assembly 10 has an ON-OFF electric power switch 43, a trigger 11 with electric firing switch 45, an ambidextrous thumb-operated safety 9 with an electric "ON-OFF" safety switch 44, a trigger guard 29, an internal storage capacity for a LiPO battery 18, and a base 37 with a sliding bottom entry battery access door. Individual less-lethal ammunition options are selected electronically through the CMOS circuit on PCB 21 by cycling the trigger 11 with the external safety lever 9 in the "ON" position, as is shown in the figure. When the safety lever 9 is depressed downward to the "OFF" position, electric safety switch 44 is closed and sends a signal to the PCB 21 electronic control circuit. In this condition, pulling the trigger 11 closes the electric firing switch 45 sending a signal to the PCB 21 electronic control circuit which fires the currently selected less-lethal ammunition dispenser, and then cycles the selector to the next less-lethal ammunition option.

PCB 21 is comprised of three CMOS chips 40, 41, 42 connected to the pistol-style hand grip 10 by wiring harness 23, which transmits power to PCB 21 when switch 43 is ON, transmits ON-OFF status of safety lever 9 via safety switch 44, and transmits FIRE commands from trigger 11 firing switch 45 to PCB 21. Wiring harness 24 connection to PCB 8 is used to transmit power when switch 43 is ON, to transmit ON-OFF status of safety lever 9, and to transmit specific barrel selection from PCB 21 to PCB 8. This information is displayed by barrel selection LEDs 25, power ON-OFF LED 27, and safety ON-OFF status LED 26. Chip 40 on PCB 21 is a 556 dual timer with associated timing resistors and capacitors, an LM4017 decade counter 41, and one or more LM4081 quad two-input AND gates 42. Chip 40 produces two consecutive signal pulses when the trigger 11 is pulled and trigger switch 45 is closed. The first pulse is a 0.25 second wide FIRE pulse. At the end of the FIRE pulse, a 50 millisecond barrel CYCLE pulse is generated. If the safety 9 is in the OFF position and safety switch 44 is closed when the FIRE pulse is generated, a firing pin activation signal is sent through wire harness 36 to the firing pin assembly attached to the currently selected LLA dispenser; otherwise no firing pin activation signal is sent. At the end of the subsequent CYCLE pulse, the next dispenser in a programmed sequence is selected.

Figure 7C:
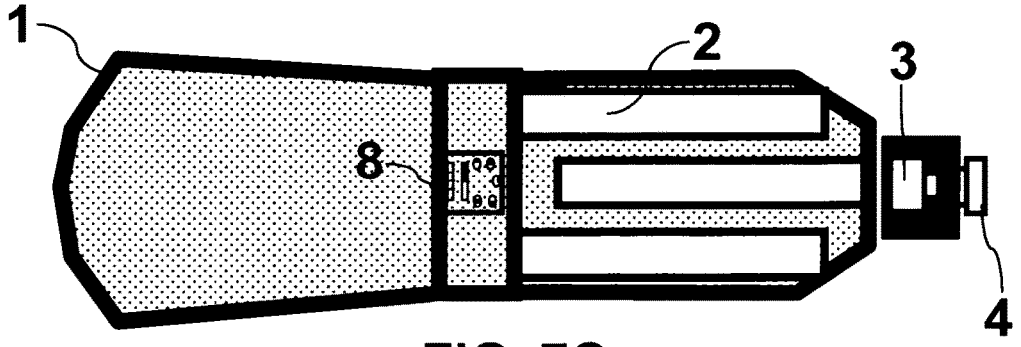
FIGS. 7A, 7B, and 7C comprise a 3-view schematic illustrating the features of a three barrel embodiment.
Figure 7B:
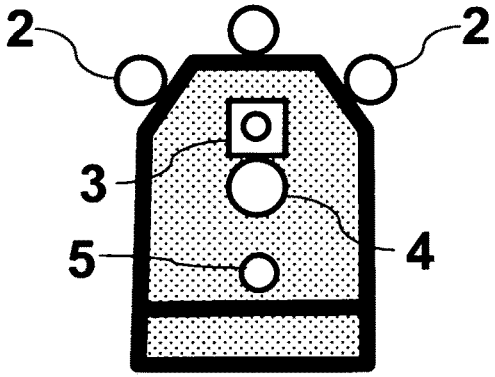
Figure 7A:
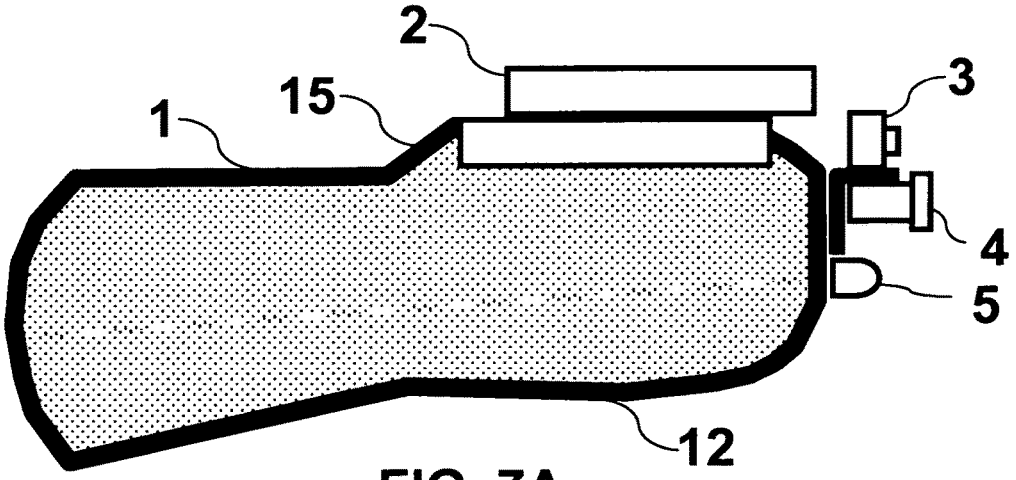

FIGS. 7A, 7B, and 7C comprise a 3-view schematic illustrating the features of a representative embodiment with external less-lethal barrel mountings. The side view FIG. 7A, illustrates gauntlet sleeve assembly 1,12,15 with only three barrels 2 attached, as well as a forward mounted flashlight 3, laser designator 5 and video camera 4. Front view FIG. 7B, shows the lateral spread arrangement of the mounted barrels 2, and top view FIG. 7C, shows the fore-aft stagger of the barrel arrangement, as well as the location of status display panel 8.

Figure 8A:
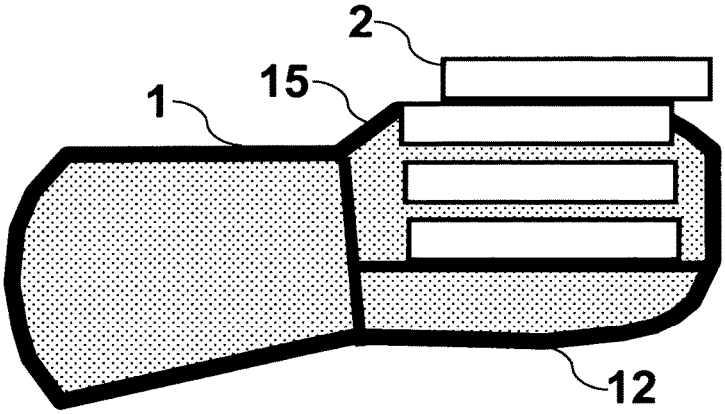
FIGS. 8A and 8B comprise a 2-view schematic illustrating the features of a seven barrel embodiment.
Figure 8B:
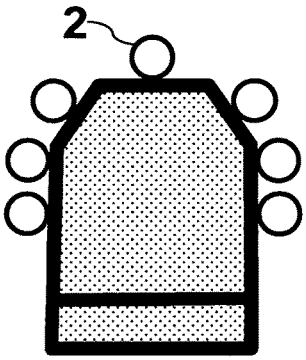

FIGS. 8A and 8B comprise side and front schematic views illustrating the features of a representative embodiment with external LLA dispenser mountings. The side view FIG. 8A illustrates gauntlet sleeve assembly 1,12,15 with a total of seven 12-gauge barrels 2 attached. Front view FIG. 8B shows the lateral spread arrangement of the mounted barrels 2, and side view FIG. 8A shows the fore-aft stagger arrangement of the upper three barrels.

Figure 9A:
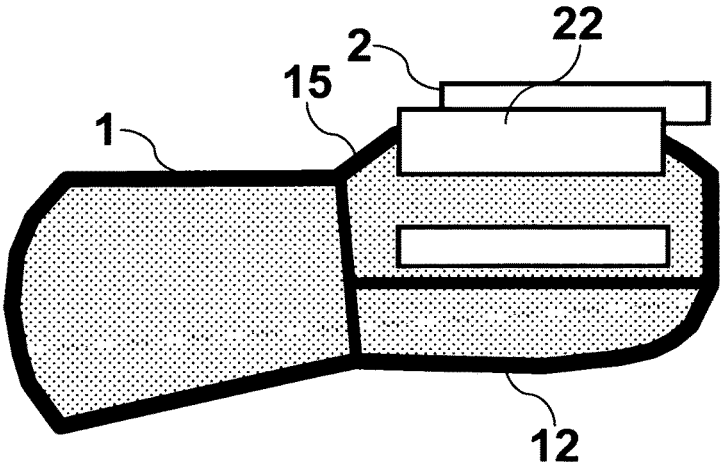
FIGS. 9A and 9B comprise a 2-view schematic illustrating the features of a mixed caliber five barrel embodiment.
Figure 9B:
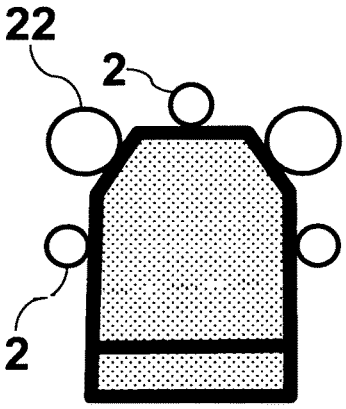

FIGS. 9A and 9B comprise side and front schematic views illustrating the features of a representative embodiment with mixed caliber barrel mountings. The side view FIG. 9A illustrates the full gauntlet sleeve assembly 1,12,15 with only five total barrels attached. Three barrels 2 of the five barrels are 12-gauge and two barrels 22 are 40 mm caliber. Front view FIG. 9B shows the lateral spread arrangement of the mounted barrels 2 and 22, and side view FIG. 9A shows the fore-aft stagger arrangement of the upper three barrels.

Accordingly, the present invention provides several other advantages over conventional less-lethal ammunition dispensers. One advantage of the present invention compared to conventional shotguns is that the launcher can be held, manipulated, and fired with one hand, is easily maneuvered in confined urban settings, and can be conveniently stored and carried hands free if desired. The gauntlet sleeve assembly provides protection for an operator hand and forearm up to the elbow using the lightweight carbon fiber or reinforced polymer materials construction. A further significant advantage that the present invention provides is a selectable multiple shot capacity, which is a feature that no other less-lethal firearm currently has. The electronic ammunition dispenser selection and fire control system provides simplicity of operation and reliability. Each attachment point having a less-lethal ammunition option is independently selectable for firing from inside the gauntlet sleeve assembly. The invention thus provides for unique multiple, selectable less-lethal ammunition dispenser options in a single hand-held device, essentially combining multiple less-lethal weapons into one device. The invention may further be configured by an operator "on-scene" as required for specific tactical situations allowing for escalation of less-lethal force.

It is to be understood that even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed. The invention includes all such changes and modifications made within the scope of the present invention without departing from the spirit thereof.

What is claimed is:

1. A personal protection device comprising:

a separable 3-piece forearm gauntlet sleeve assembly, said gauntlet sleeve assembly having a rear forearm piece, a front upper piece, and a front lower piece, wherein said 3-piece forearm gauntlet sleeve assembly encloses the hand, wrist, and forearm up to the elbow; and wherein each of the said three pieces is constructed of any combination of the following: carbon fiber composite, aramid synthetic fiber, fiberglass, laminated graphene sheets, aluminum, titanium, and steel;

an electronic control system comprising an internal 3-chip CMOS printed circuit board for processing barrel selection and executing firing commands; said electronic control system attaching removably to the front upper piece of the gauntlet sleeve assembly; wherein said electronic control system connects by wiring harness to a manual control system, a system status display panel, and to electrically operated gauntlet sleeve assembly attachments;

a manual control system comprising an ambidextrous pistol-type hand grip, an internal, removable, rechargeable battery, an embedded ON-OFF electric power switch, a trigger mechanism with an internal electric switch, and an embedded electric FIRE-SAFE safety switch, said manual control system attaching removably to the inside of the front upper piece of the said gauntlet sleeve assembly, operable by a single hand, and wherein the said battery and electrical switches attach by wiring harness to the said electronic control system;

an external personal protection device status panel comprising LEDs and a battery voltage meter for externally displaying device status and barrel selection, said panel further attaching by wiring harness to the said electronic control system;

multiple attachment points accommodating one or more of each of the following electrically operated options: individual lightweight, vented, shortened composite barrels of multiple calibers for dispensing less-lethal ammunition, self-contained less-lethal ammunition dispensers not requiring a barrel, electroshock weapons, chemical irritant cartridges, and tactical equipment to include laser designators, flashlights, and video cameras; wherein said attachment points are connected by wiring harness to the said electronic control system so as to be electrically operated on command from the manual control system as processed by the said electronic control system;

wherein the personal protection device is readily configurable by an operator so as to have multiple desired electrically activated less-lethal ammunition dispensers and tactical equipment;

and further wherein the personal protection device provides the capability to the operator for single-hand-only operation to switch the device power ON and OFF, to switch the device state from SAFE to FIRE, and to select and activate said less-lethal ammunition dispensers and tactical equipment in any desired sequence.

2. A personal protection device according to claim 1, wherein the rear forearm piece of the 3-piece gauntlet sleeve assembly covers the arm from wrist to elbow and is detachable so that the front upper piece and the front lower piece of the forearm gauntlet sleeve, which enclose the entire hand and wrist, are thus configured as a separately functional 2-piece unit; and further wherein both the rear forearm piece and the front lower piece of the 3-piece gauntlet sleeve assembly are separately detachable from the front upper piece of the forearm gauntlet sleeve assembly, to which the pistol grip manual control system is attached, so as to form a separately functional configuration of the personal protection device; and further wherein each of the resulting configurations have a different weight, protective surface area, ammunition dispenser capability and tactical gear capability different from the full 3-piece gauntlet sleeve assembly.

3. A personal protection device according to claim 1, wherein multiple hardpoints are embedded in or secured to each of the three separable gauntlet sleeve pieces; said hardpoints composed of machined and drilled metal brackets for attaching additional Picatinny Rails or attaching retaining brackets for various tactical equipment, said tactical equipment to include a laser designator, a flashlight, and a video camera.

4. A personal protection device according to claim 1, wherein one or more of a laser designator, video camera, or tactical flashlight externally attached to the gauntlet sleeve pieces are activated by a firing safety switch.

5. A personal protection device according to claim 1, wherein acceptance slots, retaining brackets and control wiring are provided for attaching one or more electroshock weapon cartridges and chemical irritant cartridges to the front upper or front lower gauntlet sleeve assembly pieces.

* * * * *